US006213267B1

(12) United States Patent
Miller

(10) Patent No.: US 6,213,267 B1
(45) Date of Patent: Apr. 10, 2001

(54) PORTABLE LUGGAGE CASE WITH DETACHABLE TOTE BAG PORTION

(75) Inventor: Jacqueline N. Miller, Boca Raton, FL (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 09/370,528

(22) Filed: Aug. 6, 1999

(51) Int. Cl.[7] ..... A45C 3/00

(52) U.S. Cl. ..... 190/108; 190/110; 190/115; 190/102

(58) Field of Search ..... 190/18 A, 109, 190/110, 111, 107, 108; 206/289

(56) References Cited

U.S. PATENT DOCUMENTS

| | | | | |
|---|---|---|---|---|
| 1,491,807 | | 4/1924 | McLinn . | |
| 3,122,225 | * | 2/1964 | Ward | 190/109 X |
| 4,081,061 | | 3/1978 | Tucker . | |
| 4,436,189 | * | 3/1984 | Baum | 190/108 X |
| 4,564,091 | | 1/1986 | Coneglio . | |
| 4,723,300 | * | 2/1988 | Rosalind | 190/1 X |
| 4,756,394 | * | 7/1988 | Cohen | 190/116 X |
| 4,898,274 | * | 2/1990 | Stout et al. | 190/108 X |
| 5,437,367 | | 8/1995 | Martin . | |
| 5,547,052 | | 8/1996 | Latshaw . | |
| 5,588,749 | * | 12/1996 | Ishikawa | 383/4 X |
| 5,676,223 | | 10/1997 | Cunningham . | |
| 5,680,914 | | 10/1997 | Reiser . | |
| 5,782,325 | * | 7/1998 | O'Shea et al. | 190/18 A |
| 5,810,132 | * | 9/1998 | Chang | 190/18 A |
| 5,875,876 | | 3/1999 | Wang . | |
| 6,098,769 | * | 8/2000 | Yen | 190/108 |

* cited by examiner

*Primary Examiner*—Allan N. Shoap
*Assistant Examiner*—Tri M. Mai
(74) *Attorney, Agent, or Firm*—Akerman Senterfitt

(57) ABSTRACT

A portable luggage carrying case having a detachable carry tote portion capable of housing a lap-top computer, and various computer accessories. The detachable carry tote is joined to the main portion of the luggage enclosure via a zipper situated around the periphery of the main portion and the carry tote. Once separated from the main portion, the carry tote, comprised of an upper and a lower section joined together along its adjacent edges via material along the inner-facing surface of each section, can be folded, and a securing zipper used to secure the upper and lower portions to each other in a face-to-face configuration. The carry tote, with lap-top computer stored within one of its zippered pouches, can now be utilized separately and independently from the main portion of the luggage enclosure. The present invention provides for a zipper that secures the carry tote bag sections to each other, and also is used to join the main portion with the detachable portion of the luggage enclosure, thereby eliminating the need for an additional zipper or joining means. The present invention provides a combination luggage carrying case and portable computer storage case in one unit.

12 Claims, 4 Drawing Sheets

PORTABLE LUGGAGE CASE WITH DETACHABLE TOTE BAG PORTION

BACKGROUND OF THE INVENTION

1. Field of the Invention

The present invention relates to a portable luggage carrying case and, more particularly, to a portable carrying case having a front face that can be detached to form a carry tote bag which can store various items such as a lap-top computer, computer accessories, and other miscellaneous items. The tote bag includes a shoulder strap to allow the tote to be carried and used independently of the carrying case and wherein the tote bag utilizes the same securing means as is used to join the front face to the main body portion of the carrying case thus eliminating the need for additional securing zippers.

2. Background Art

Portable luggage enclosures having detachable components are well known in the art. Lap-top computers are extremely popular today, and it is common for travellers in airport terminals to be seen with a lap-top carrying case slung over their shoulders. Portable luggage carriers are also very common, and travellers can be seen rolling these along the ground as they hurry to catch their flight. However, most airlines limit travellers to only two on-board carry items. If the traveller has an additional carry-on item, along with their portable luggage case, and their lap-top computer carrying case, one of the three will have to be stowed underneath the airplane. Further, many airlines have restrictions on size and weight requirements for carry-on luggage. Therefore, what is needed is a one-piece combination luggage case-portable computer case, where the computer-carrying tote bag can be detached from the portable luggage case, and the remaining main body portion of the luggage case conforms to the maximum allowable size as required by the Federal Aviation Administration (FAA) guidelines. After use, the tote bag can be re-attached to the main portion of the luggage case to again one unit.

U.S. Pat. No. 5,547,052 issued to Latshaw discloses a portable luggage system of modular components particularly sized to be positioned underneath an airplane passenger's seat or in the overhead storage bins above the passenger.

U.S. Pat. No. 5,676,223 issued to Cunningham discloses a business case having a front, middle, and expandable rear compartment, a removable computer carrying case, and a suit carrier.

U.S. Pat. No. 5,875,876 issued to Wang discloses a wheeled luggage assembly including a body portion having a primary case and a secondary case in engagement with the primary case by means of a zipper.

U.S. Pat. No. 4,081,061 issued to Tucker discloses a plurality of independent luggage pieces capable of functioning independently of each other and fastened via fastening means to secure the separate pieces as one structure.

However, none of these references disclose a portable luggage carrying case having a removable face, which can be detached, folded and converted into a tote bag sized to house a portable computer or other items, and capable of being used independently from the carrying case.

Consequently, there is a need in the art for a luggage carrying case in combination with a removable tote bag capable of storing and transporting a lap-top computer or other accessories.

SUMMARY OF THE INVENTION

The portable luggage case with detachable tote bag of the present invention solves the problems encountered by the prior art by providing a portable luggage case having a front and back face wherein one of its faces can be removed to create a separate tote bag which is sized to house a portable computer, and computer accessories. The tote bag is foldable and can be secured by a zipper, where the zipper is the same securing means used to secure the tote bag to the main portion of the luggage case when the tote is in its unfolded position. Further, by providing a removable tote bag portion, a user may carry-on each case, and comply with FAA standards which restrict the size and weight of carry-on luggage. By removing the tote bag, the main luggage-carrying portion, which is conveniently sized to conform to FAA regulations, can be carried on-board an airplane without any restrictions.

Accordingly, in the preferred embodiment, the portable luggage enclosure with a detachable tote bag capable of housing a lap-top computer comprises a luggage enclosure having a main body portion, and a detachable portion, wherein the main body portion includes one or more storage compartments, one sized to receive clothing, and the detachable portion includes one or more enclosures, one of which is sized to receive a portable computer or other items and wherein the detachable portion can be used as a tote bag, briefcase, backpack or any other type of carrying case.

The present invention also includes means for removably joining the main body portion to the detachable portion. The joining means comprises a first zipper component situated around the periphery of the main housing, a second zipper component situated around the periphery of the detachable portion, and a zipper fastening element movably affixed to the second zipper component along the periphery of the detachable tote portion. The detachable portion is a one-piece tote bag and comprised of an upper and lower section foldably connected to each other along its adjacent edges, wherein the detachable portion also includes securing means capable of securing the upper section to the bottom section when said detachable portion is in a folded, face-to-face configuration.

In the preferred practice of the present invention, the securing means are comprised of a second zipper component situated around the periphery of the detachable portion. The second zipper component comprises a portion of the zipper used to attach and detach the main housing from the detachable portion.

A wheel assembly comprised of a plurality of wheels is rotatably affixed to the bottom of the main body of the luggage enclosure.

A retractable handle is mounted upon the top of the main body portion. The retractable handle can be raised or lowered via a manually activated button situated on or near the retractable handle.

The detachable portion of the luggage enclosure includes a shoulder strap, wherein each end of the shoulder strap can be removably secured to a side of the detachable portion when in a folded orientation. Thus after the lower section of the detachable portion has been secured to the upper section of the detachable portion by the closing of the zipper via the zipper fastening element, the shoulder strap having ends affixed to each side of the folded, detachable portion, can be used to facilitate the transport of the folded detachable portion of the luggage enclosure. A lifting handle may be mounted upon the top of the main housing portion, to further facilitate transport.

The present invention improves upon the problems in the art by providing a detachable storage tote which allows the remaining main portion of the luggage case to utilize its entire interior for storage. Most portable luggage cases have a front, non-detachable compartment used to store items. However, because this front compartment cannot be removed from the luggage case, the overall storage capacity of the main body portion of the luggage case is reduced by several inches.

It is, therefore, a principle object of this invention to provide a portable luggage enclosure which includes a detachable portion removably joined to one face of the luggage enclosure's main body portion, via joining means, thereby allowing the remaining main body portion to be used to its maximum storage capacity.

It is also an object of this invention to provide securing means which secures the upper section of the detachable portion to the lower section of the detachable portion, thereby providing a zippered, detachable carry tote bag capable of housing and transporting a portable computer.

It is still yet another object of this invention to insure that the carry tote securing means utilizes a component of the joining means thereby eliminating the need for additional securing or joining devices.

In accordance with these and other objects which will become apparent hereinafter, the instant invention will now be described with particular reference to the accompanying drawings.

DETAILED DESCRIPTION OF THE PREFERRED EMBODIMENT

Figure 1:
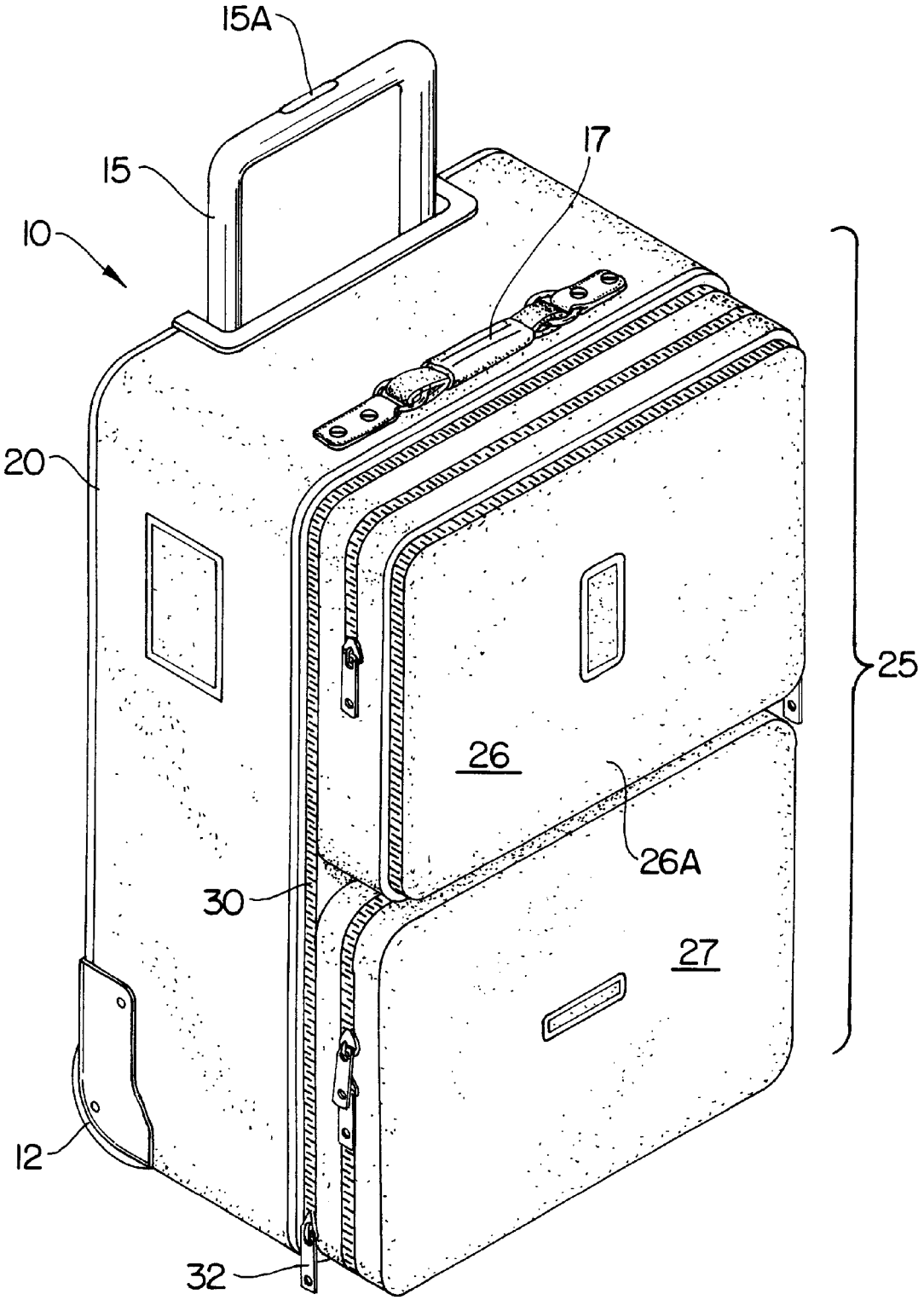
FIG. 1 is a perspective view of the invention.

Referring to FIG. 1, a portable luggage carrying case 10 is shown in perspective view in accordance with the preferred embodiment of this invention, including, retractable handle 15 having a handle release button 15A, lifting handle 17. Also shown is main housing 20, detachable portion 25 which comprises the front face of case 10, zipper 30 securing main housing 20 to detachable portion 25, and wheels 12. Upper section 26 and lower section 27 comprise detachable portion 25.

Figure 2:
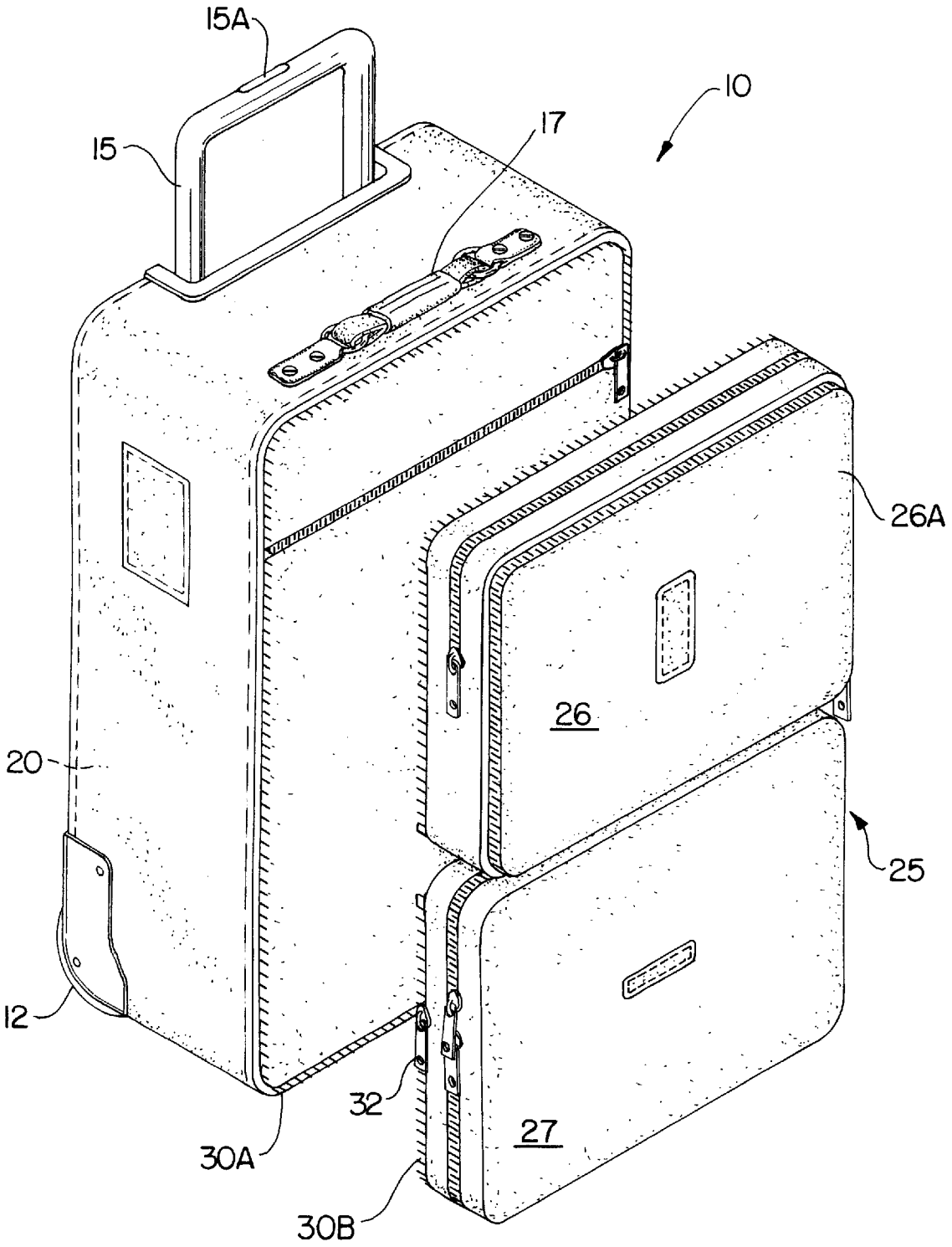
FIG. 2 is a perspective view of the invention showing the front face detached from the carrying case.

FIG. 2 shows the portable carrying case 10 in its separated configuration after the release of zipper 30. This figure shows the two main components of carrying case 10, namely main housing 20, and detachable portion 25 after separation. In the preferred practice of the present invention, detachable portion 25 is removably secured to main housing 20 via a zipper 30 (FIG. 1), which encircles detachable portion 25 and main housing 20. After separation, zipper component 30A, comprised of a plurality of teeth-like elements, remains around the outer periphery of main housing 20. Zipper component 30B also comprised of a plurality of teeth-like elements, remains around the outer periphery of detachable portion 25. Zipper component 30B also includes a zipper fastening element 32 movably affixed to zipper component 30B.

Figure 3:
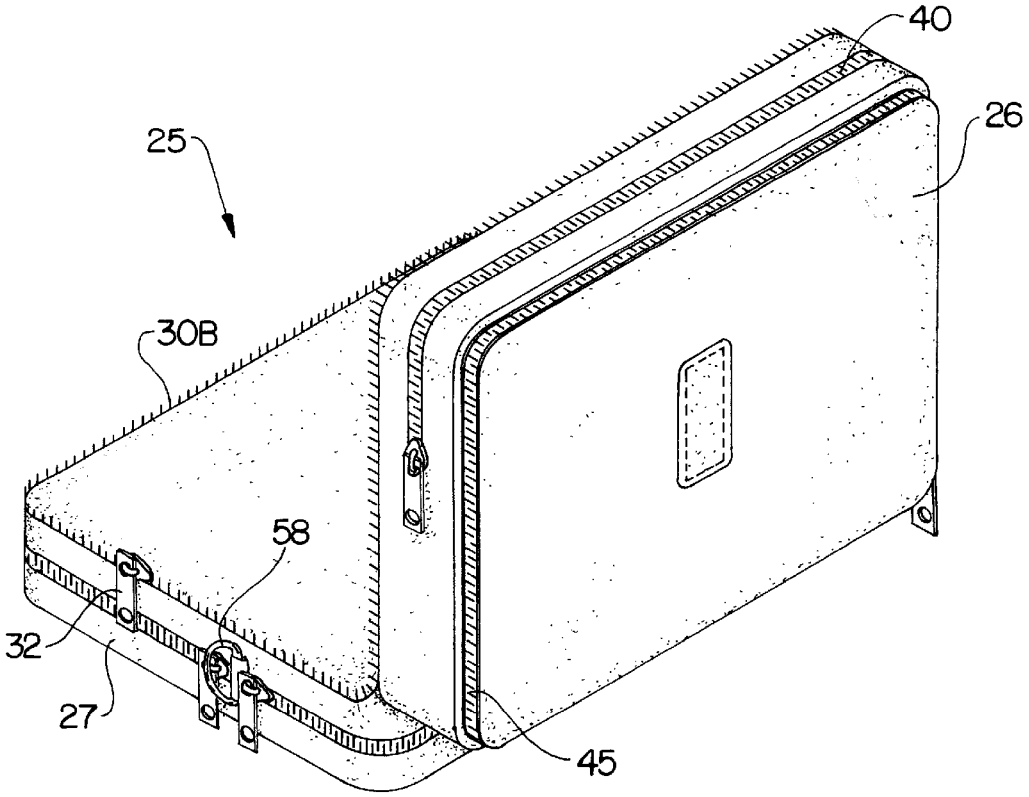
FIG. 3 is a perspective view of the tote after removal from the carrying case.

Carrying case 10 includes a front and a back face (not shown) wherein the front face is actually comprised of the front face of detachable portion 25. Detachable portion 25 comprises an upper section 26 and a lower section 27, foldably connected to each other along their adjacent horizontal edges. In FIG. 2, upper and lower sections are shown to be substantially co-planar, while in an open configuration. In FIG. 3, upper and lower sections are shown in a semi-folded configuration. Zipper 40 is situated around a portion of the periphery of upper section 26. Zipper 40 can be released to reveal a pocket therein. This pocket can be sized to house a portable lap-top computer. Zipper 45 can be released to reveal two separate compartments 47 and 48 (seen in FIG. 4). These compartments, separated by divider 49, can store computer-related documentation, computer disks, or files.

Referring once again to FIG. 2, it can be seen that upper section 26 and lower section 27 are joined along their adjacent edges. The sections are joined by material extending along the inside-facing surface of each section. As can be seen in FIG. 2, a small which can be space, approximately ½ inch exists between the horizontal edges of the upper and lower sections, along their outer-facing surfaces. This space allows for the folding of one or both of the sections, in order to secure the tote bag, as seen in FIG. 3 and FIG. 4.

FIG. 2 shows detachable portion 25 in its open configuration upon removal from main housing 20. In its open position, the upper and lower sections, 26 and 27, respectively, are virtually co-planar. After separation, detachable portion 25 can be folded, and secured as seen in FIG. 4. A securins means can comprise zipper component 30B, the component that remained on detachable portion 25 after separation from main housing 20. When detachable portion 25 is folded, as in FIG. 4, zipper component 30B can be zipped closed via zipper fastening element 32 movably affixed along the outer periphery of detachable portion 25, and riding along the teeth-like elements of zipper component 30B.

As seen in FIG. 2, detachable portion 25 features zipper portion 30B around its periphery, while zipper component 30A remains around the periphery of main housing 20. Advantageously, upon folding of detachable portion 25, zipper component 30B along with zipper fastening element 32, are used to form the securing means 31, maintaining lower section 27 and upper section 26 in a face-to-face orientation, as seen in FIG. 4. The tote bag, as seen in FIG. 4, is therefore created upon the folding and securing of the upper and lower sections utilizing securing means 31, which includes zipper portion 30B and zipper fastening element 32. Because zipper portion 30B comprises a component of the zipper used to join main housing 20 with detachable portion 25 there is no need for additional zippers to secure the tote bag subsequent to its being detached from the main housing and folded.

Figure 4:
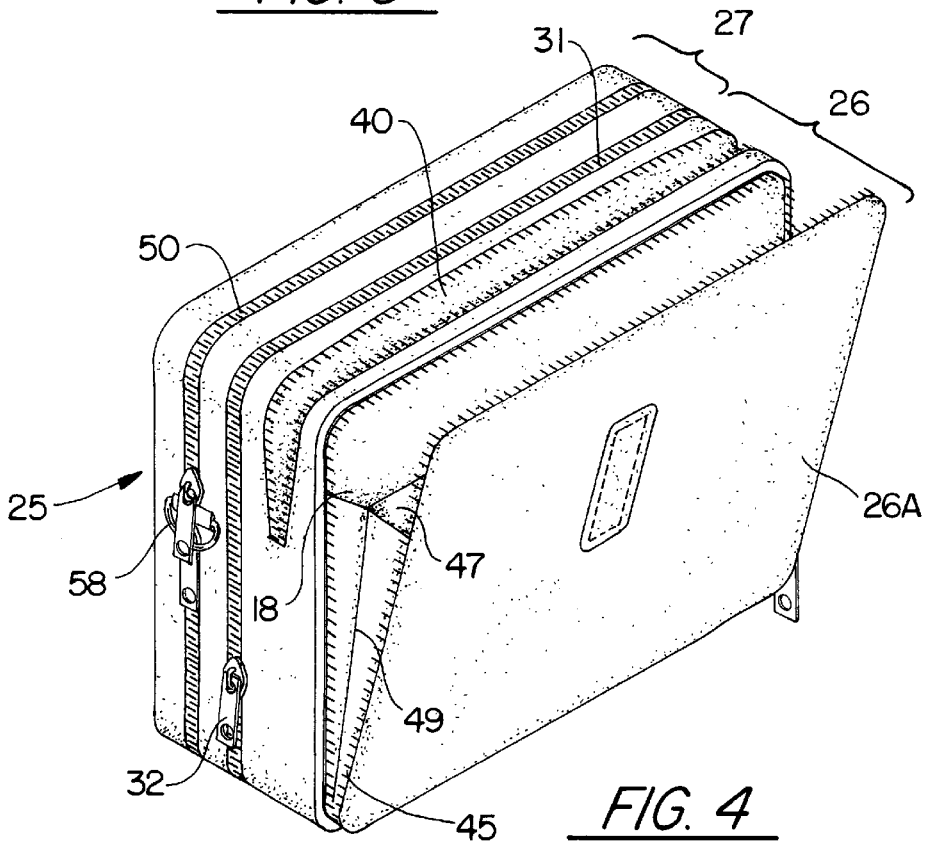
FIG.4 is a perspective view of the detached carry tote open to receive a computer and associated files.

FIG. 4 shows the detachable portion 25 completely separated from the main housing. Front face 26A of upper section 26 is shown to be slightly open due to the release of zipper 40. Zipper 45 is opened to reveal the two interior compartments, 47 and 48, separated by a divider 49. Compartments 47 and 48 can house computer disks, manuals, or other documentation. Computer housing zipper 40, is a zipper used to enclose the portable computer within a compartment contained therein. Securing means 31 is comprised of a zipper, represented by the joining of zipper components 30A and 30B, via the zipper fastening element 32. Zipper 31 secures the upper section 26 and lower section 27 to each other. Zipper 50 encloses yet another compartment, used to store miscellaneous items.

Referring once again to FIG. 2, which depicts detachable portion 25 in its open configuration, upper section 26 and lower section 27 can be approximately 10 ¼ inches along their vertical edge can be 14 inches across their horizontal edge.

FIG. 4 shows the detachable portion 25 in a folded orientation with upper section 26 and lower section 27 face-to-face and secured by securing means 31.

Figure 5:
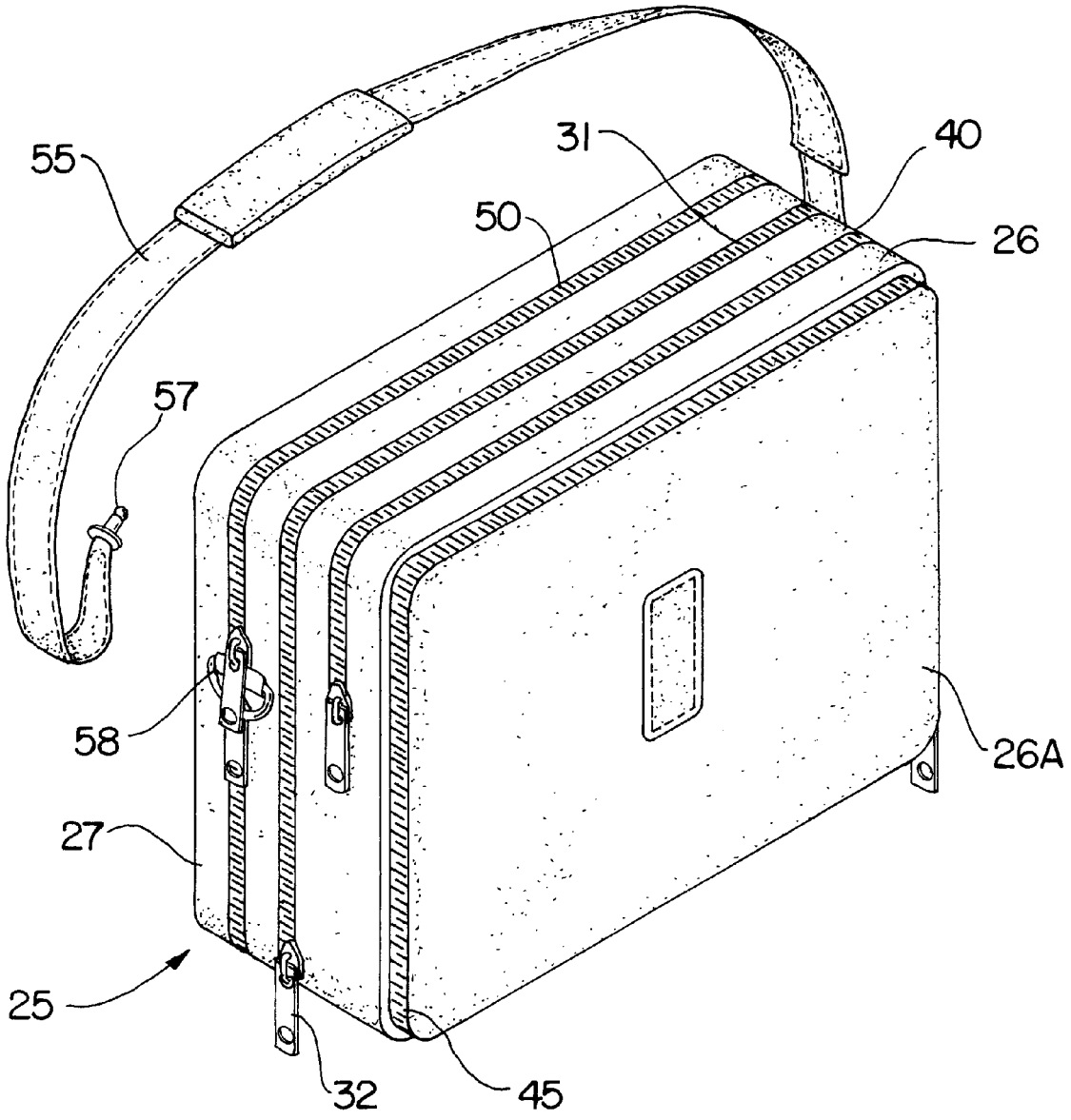
FIG. 5 is a perspective view of the carry tote with shoulder strap.

FIG. 5 shows the detachable tote portion 25 in its completely secured configuration. A portable lap-top computer is housed within the compartment enclosed by zipper 40. Securing zipper 31 secures the upper and lower sections. Zipper 31 can be seen to extend along the top side of the tote bag as well as the sides of the tote bag. The underside portion of the tote bag is already joined via the mating material that connects the two sections along their adjacent horizontal edges as shown in FIG. 2. Shoulder strap 55 can be fastened to each side of the tote bag via use of fastening means 57 on the strap 55 and fastening loops 58, one of which can be affixed to each side of the tote bag 25.

The Federal Aviation Administration (FAA) has imposed restrictions regarding the size of carry-on luggage. The maximum dimensions for carry-on luggage is presently 9"×22"×14" or 45 total linear inches. The present invention satisfy these requirements when the detachable tote portion 25 has been removed from the main housing 20. The main housing portion of the luggage case is preferably approximately 7 inches thick, 20 and ½ inches high, and 14 inches wide. Therefore, the present invention allows a user to detach the tote bag portion, store a portable computer or other items therein, and carry the tote bag on board of an airplane separately, along with the main housing portion which stores the passenger's clothes. After the flight, the computer-carrying tote bag can be re-attached to the main housing, and the entire luggage carrying case be rolled conveniently to a new location.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable luggage carrying case, comprising:

a substantially rectangular luggage enclosure having a main body component and a detachable body component;

joining means for removably joining said main body component to said detachable body component, said joining means comprising a first zipper element situated around a periphery of said main body component, a second zipper element situated around a periphery of said detachable body component, and a zipper mating element movably affixed to said second zipper element;

wherein said detachable body component comprises a first section having a first peripheral portion foldably joined to a second section having a second peripheral portion; and wherein said zipper mating element is selectively operable for joining said first zipper element of said main body component with said second zipper element of said detachable body component when said detachable body component is in a non-folded configuration, and selectively operable for joining said first peripheral portion to said second peripheral portion when said detachable body component is in a folded configuration.

2. The carrying case of claim 1 further comprising a wheel assembly having a plurality of wheels wherein said wheels are rotatably affixed to said luggage enclosure.

3. The carrying case of claim 1 wherein said main body component further includes a retractable handle mounted upon said main body component, wherein said handle can be raised or lowered via handle release means.

4. The carrying case of claim 3 wherein said handle release means comprises a manually activated button situated proximate said retractable handle.

5. The carrying case of claim 1, wherein said main body component includes at least one storage compartment.

6. The carrying case of claim 1 wherein said detachable body component further comprises substantially opposing sides, and a shoulder strap having opposing ends, wherein each end of said shoulder strap is removably secured to one of said substantially opposing sides of said detachable component.

7. The carrying case of claim 1 further comprising a lifting handle mounted upon the top of said main body component.

8. The carrying case of claim 1, wherein said detachable body component is at least one of the group consisting of a backpack, a tote bag, a duffel bag, and a suitcase.

9. The carrying case of claim 1, wherein said main body component has a height of approximately 20 inches, a width of approximately 14 inches, and a thickness of approximately seven inches when said main body component is detached from said detachable body component.

10. The carrying case of claim 1, wherein said detachable body component has at least one compartment sized to receive a portable computer.

11. A portable luggage carrying case with a detachable carry tote bag capable of housing a lap-top computer comprising:

a substantially rectangular luggage enclosure having a main body component, said luggage enclosure having one or more storage compartments, and a detachable component, wherein said detachable component has opposing substantially vertical sides, and includes one or more enclosures, one of which is sized to receive a portable computer;

means for removably joining said main body component to said detachable component wherein said joining means comprises a first zipper element situated around the periphery of said main body component, a second zipper element situated around the periphery of said detachable component, and a zipper mating element movably affixed to said second zipper element;

said detachable component comprising:

an upper section having opposing vertical sides, a top substantially horizontal side, and a bottom substantially horizontal side; and a lower section having opposing vertical sides, a top substantially horizontal side, and a bottom substantially horizontal side, wherein said upper section is foldably joined to said lower section along said lower horizontal side of said upper section and said upper horizontal side of said lower section;

securing means capable of securing said upper section to said bottom section when said detachable portion is in a folded configuration, wherein said securing means comprises said second zipper element in engagement with said zipper mating element;

a wheel assembly having a plurality of wheels wherein said wheels are rotatably affixed to said luggage enclosure; and a handle mounted upon said luggage enclosure.

12. A portable luggage carrying case with a detachable carry tote bag capable of housing a lap-top computer comprising:

a substantially rectangular luggage enclosure having a main body component, said luggage enclosure having one or more storage compartments, and a detachable component, wherein said detachable component has opposing substantially vertical sides, and includes one or more enclosures, one of which is sized to receive a portable computer;

means for removably joining said main body component to said detachable component wherein said joining means comprises a first zipper element situated around the periphery of said main body component, a second zipper element situated around the periphery of said detachable component, and a zipper mating element movably affixed to said second zipper element;

said detachable component comprising:

an upper section having opposing vertical sides, a top substantially horizontal side, and a bottom substantially horizontal side; and a lower section having opposing vertical sides, a top substantially horizontal side, and a bottom substantially horizontal side, wherein said upper section is foldably joined to said lower section along said lower horizontal side of said upper section and said upper horizontal side of said lower section;

securing means capable of securing said upper section to said bottom section when said detachable portion is in a folded configuration, wherein said securing means comprises said second zipper element in engagement with said zipper mating element;

a wheel assembly having a plurality of wheels wherein said wheels are rotatably affixed to said luggage enclosure;

a retractable handle mounted upon said main body component, wherein said handle can be raised or lowered via a manually activated button situated proximate said retractable handle;

said detachable component further comprises a shoulder strap, wherein each end of said shoulder strap is removably secured to said vertical side of said detachable component; and a lifting handle mounted upon the top of said main body component.

* * * * *

UNITED STATES PATENT AND TRADEMARK OFFICE

CERTIFICATE OF CORRECTION

PATENT NO. : 6,213,267 B1
DATED : April 10, 2001
INVENTOR(S) : Jacqueline Miller It is certified that error appears in the above-identified patent and that said Letters Patent is hereby corrected as shown below:

Column 3,
Line 45, before "lifting handle" insert -- and --.

Column 4,
Line 19, replace "a small which can be space," with -- a small space which can be --.
Line 28, replace the word "securins" with the word -- securing --.

Column 5,
Line 23, before the word "satisfy" add the word -- can --.

Claim 6, column 6,
Line 14, after the word "detachable" add the word -- body --.

Signed and Sealed this

Nineteenth Day of February, 2002

*Attest:*

*Attesting Officer*

JAMES E. ROGAN
*Director of the United States Patent and Trademark Office*